US008720833B2

(12) United States Patent
Jack

(10) Patent No.: US 8,720,833 B2
(45) Date of Patent: May 13, 2014

(54) LAWN BAG APPARATUS

(75) Inventor: Robert C. Jack, Schaumburg, IL (US)

(73) Assignee: R2 Design Lab, Inc., Schaumburg, IL (US)

( * ) Notice: Subject to any disclaimer, the term of this patent is extended or adjusted under 35 U.S.C. 154(b) by 201 days.

(21) Appl. No.: 13/437,220

(22) Filed: Apr. 2, 2012

(65) Prior Publication Data

US 2013/0259405 A1 Oct. 3, 2013

(51) Int. Cl.
*B65B 67/04* (2006.01)

(52) U.S. Cl.
USPC ..... 248/99; 248/95; 248/100; 248/101

(58) Field of Classification Search
CPC .... B65B 67/12; B65B 67/1233; B65F 1/1415
USPC ..... 248/99, 100, 101, 95; 141/390, 391
See application file for complete search history.

(56) References Cited

U.S. PATENT DOCUMENTS

| | | | | | |
|---|---|---|---|---|---|
| 999,406 | A * | 8/1911 | Skelton | 248/97 |
| 1,375,590 | A * | 4/1921 | Hurlbutt | 248/99 |
| 1,665,724 | A * | 4/1928 | Way | 248/101 |
| 2,113,153 | A * | 4/1938 | Jonassen | 248/101 |
| 2,504,572 | A * | 4/1950 | Nygard | 248/97 |
| 2,815,186 | A * | 12/1957 | Miller | 248/99 |
| 3,298,647 | A * | 1/1967 | Shepard | 248/101 |
| 4,034,885 | A * | 7/1977 | Hunckler et al. | 220/524 |
| 4,576,350 | A * | 3/1986 | Bond | 248/97 |
| 4,815,866 | A * | 3/1989 | Martone | 383/34.1 |
| 5,048,778 | A * | 9/1991 | Wright | 248/98 |
| 5,154,378 | A * | 10/1992 | Plum | 248/99 |
| 5,803,299 | A * | 9/1998 | Sealy, Jr. | 220/495.07 |
| 8,047,477 | B2 * | 11/2011 | Wilkinson | 248/99 |

OTHER PUBLICATIONS

Rake "n" Sweep, [Undated but information retrieved online at least as early as Mar. 2012];. Retrieved from the Internet: <URL:http://www.trivalleypro.com>, 1 page.

Leaf Loader, [Undated but information retrieved online at least as early as Mar. 2012];. Retrieved from the Internet: <URL:http://www.leaf-loader.com>, 1 page.

Leaf Easy, [Undated but information retrieved online at least as early as Mar. 2012];. Retrieved from the Internet: <URL:http://www.leafeasy.com>, 1 page.

Leaf Bag cart, [Undated but information retrieved online at least as early as Mar. 2012];. Retrieved from the Internet: <URL:http://www.ames.com/products/detail.aspx?ProductId=1354&SubFamilyId=41&FamilyId=40&LineId=39>, 1 page.

(Continued)

*Primary Examiner* — Anita M King
(74) *Attorney, Agent, or Firm* — Neal, Gerber & Eisenberg LLP

(57) ABSTRACT

A lawn bag apparatus to stabilize an opening of a lawn bag is disclosed, comprising a frame comprising a plurality of sidewalls arranged to approximate the opening, each sidewall comprising a midwall portion extending approximately vertically, an upper wall portion extending upwardly and outwardly from the midwall portion, and a lower wall portion extending downwardly and inwardly from the midwall portion, a first clamp positioned along one of the sidewalls, and a second clamp positioned along a sidewall opposite the first clamp, the first and second clamps being movable between an open, disengaged position and a closed, engaged position for detachably securing the frame to the lawn bag.

7 Claims, 15 Drawing Sheets

(56) References Cited

OTHER PUBLICATIONS

Semco WB-31-4 Green Lawn Funnel for Paper Bag, [Undated but information retrieved online at least as early as Mar. 2012];. Retrieved from the Internet: <URL:http://www.hardwareandtools.com/Semco-WB-31-4-Green-Lawn-Funnel-For-Paper-Bag-u268075.html?Ict=s>, 1 page.

Yardwise 13600-YW Collect It! 32-Gallon Pop-Up Debris Collection System With Cart and Detachable Scoop, [Undated but information retrieved online at least as early as Mar. 2012];. Retrieved from the Internet: <URL:http://www.amazon.com/dp/B0012FLN76/ref=asc_df_B0012FLN761900797?smid=ATVPDKIKXODER&tag=nextagus0019992-20&linkCode=asn&creative=395093&creativeASIN=B0012FLN76>, 1 page.

Ultra Hardware 31400 Yard Genie Bag Holder, [Undated but information retrieved online at least as early as Mar. 2012];. Retrieved from the Internet: <URL:http://www.amazon.com/Ultra-Hardware-31400-Genie-Holder/dp/B003A04BZW/ref=sr_1_1?s=lawn-garden&ie=UTF8&qid=1333111737&sr=1-1>, 1 page.

Rumford Gardener Rumford Gardener MGR 1000 Magic Ring Paper Yard Bag Support, [Undated but information retrieved online at least as early as Mar. 2012];. Retrieved from the Internet: <URL:http://www.sears.com/rumford-gardener-mgr1000-magic-ring-paper-yard-bag/p-SPM74458262P >, 1 page.

Snap Span, [Undated but information retrieved online at least as early as Mar. 2012];. Retrieved from the Internet: <URL:http://www.snap-span.com>, 1 page.

Leaf Mate, [Undated but information retrieved online at least as early as Mar. 2012];. Retrieved from the Internet: <URL:http://www.leafmate.com/yard-waste-bag-funnel/default.aspx>, 1 page.

Leaf & Lawn Chute—2 Pack, 13"0 Chute, $21.99 [online]. Amazon.com [Retrieved on Jun. 5, 2013 but known to be available to the public at least as early as Mar. 2012]. Retrieved from the Internet<URL:http://www.amazon.com/LeafEasy-LLCP2PK-Leaf-Lawn-Chute-2/dp/B007OYXIUO/ref=[pd_rhf_. . . >, 1 page.

* cited by examiner

LAWN BAG APPARATUS

BACKGROUND

This application relates generally to the field of outdoor lawn equipment, and particularly to an apparatus configured for use in connection with lawn bags.

Paper lawn bags are ubiquitous but notoriously difficult to use. Lawn bags are typically configured with a relatively small opening yet are often tasked with receiving large quantities of lawn and garden debris at a time. When fully articulated into the open position, the bag is configured to stand freely on the ground to enable a consumer to load the bag with debris. During use, one or more of the sidewalls of the lawn bag tend to collapse under the weight of debris striking a perimeter edge of the opening or a sidewall near the opening, causing the opening of the bag to collapse inward. Lawn bags have a propensity to buckle or collapse during use because they are constructed primarily from one or more plies of paper formed into four, relatively long sidewalls. A collapsed opening tends to slow down the process of loading additional debris into the bag.

An exemplary lawn bag having model number 49022 is manufactured by Smurfit-Stone and is available at home centers around the country. It has a 30 gallon capacity when unfolded and articulated, is made of 2-ply wet-strength paper, and is about 16 inches deep, 12 inches wide, and 35 inches tall. A bag of this type has a buckling load of approximately 1.5 lbs, meaning, the area near and around the bag opening can receive a vertical force of approximately 1.5 lbs before one of the sidewalls of the bag collapses.

Given the relatively flimsy sidewalls and small resistance to buckling, it is often a challenge to avoid collapsing the opening of the ubiquitous paper lawn bag when loading the bag with debris. What is needed, therefore, is an apparatus that at least stabilizes the opening to permit easy and quick loading of lawn and garden debris into the bag.

SUMMARY

A lawn bag apparatus to stabilize an opening of a lawn bag is disclosed, comprising a frame comprising a plurality of sidewalls arranged to approximate the opening, each sidewall comprising a midwall portion extending approximately vertically, an upper wall portion extending upwardly and outwardly from the midwall portion, and a lower wall portion extending downwardly and inwardly from the midwall portion, a first clamp positioned along one of the sidewalls, and a second clamp positioned along another of the sidewalls opposite the first clamp, the first and second clamps being movable between an open, disengaged position and a closed, engaged position for detachably securing the frame to the lawn bag.

The lawn bag apparatus may further include a pivot positioned on opposite ends of each of the first and second clamps for moving the first and second clamps between the open, disengaged position and the closed, engaged position and vice versa. The pivot may comprise a protrusion and a socket for receiving the protrusion. The first and second clamps may comprise a grip for attaching the lawn bag apparatus to the lawn bag. The grip may comprise a protrusion for piercing and protruding through a wall of the lawn bag. The sidewall nearest the protrusion may comprise an aperture for receiving the protrusion.

The plurality of frames may be joined together side by side to form an array of frames for stabilizing the opening of an array of lawn bags. Each of the plurality of joined frames may be attached to respective ones of a plurality of lawn bags.

Each of the plurality of frames may comprise a plurality of male members and a plurality of receivers positioned on adjacent sidewalls of adjacent frames for joining adjacent frames together. The receivers may be configured to detachably connect with the male members positioned on adjacent sidewalls.

The frame may permit the lawn bag to stand upright to permit filling the lawn bag with debris. The upper wall portion is configured to deflect debris into the lawn bag when the frame is oriented near or against a ground surface.

In another embodiment, a lawn bag apparatus is disclosed, comprising a frame comprising a plurality of sidewalls arranged to approximate an opening of a lawn bag, each sidewall comprising a midwall portion extending approximately vertically, an upper wall portion extending upwardly and outwardly from or near a top edge of the midwall portion, and a lower wall portion extending downwardly and inwardly from or near a bottom edge of the midwall portion, a clamp positioned along each of the sidewalls, the clamp comprising a grip for removably attaching the frame to the opening of the lawn bag to stabilize the opening.

The grip may comprise a protrusion oriented at an angle relative to a wall of the lawn bag. The protrusion is configured to pierce and protrude through the wall of the lawn bag. The clamp may be hinged to each of the sidewalls. The clamp may be hinged at or near a top edge of each of the sidewalls such that the wall of the lawn bag lies between the clamp and each sidewall when the clamp is articulated into a closed, engaged position with the lawn bag.

In another embodiment, a lawn bag apparatus for use with lawn bags is disclosed, comprising a plurality of frames detachably joined together to form an array of frames, each frame in the array comprising a plurality of sidewalls arranged to approximate an opening of a lawn bag, each sidewall comprising a midwall portion, an upper wall portion extending upwardly and outwardly from the midwall portion, and a lower wall portion extending downwardly and inwardly from the midwall portion, each frame further comprising a clamp hingedly positioned along each of the sidewalls for detachably attaching the frame to one of a plurality of lawn bags.

The upper wall portion and the lower wall portion of each of the frames may deflect debris into the plurality of lawn bags. The array may be positionable on a side of the array to receive debris in the plurality of lawn bags attached thereto. The clamp may comprise at least one protrusion for piercing and protruding at least partially through a wall of a corresponding one of the plurality of lawn bags.

DETAILED DESCRIPTION

Figure 1A:
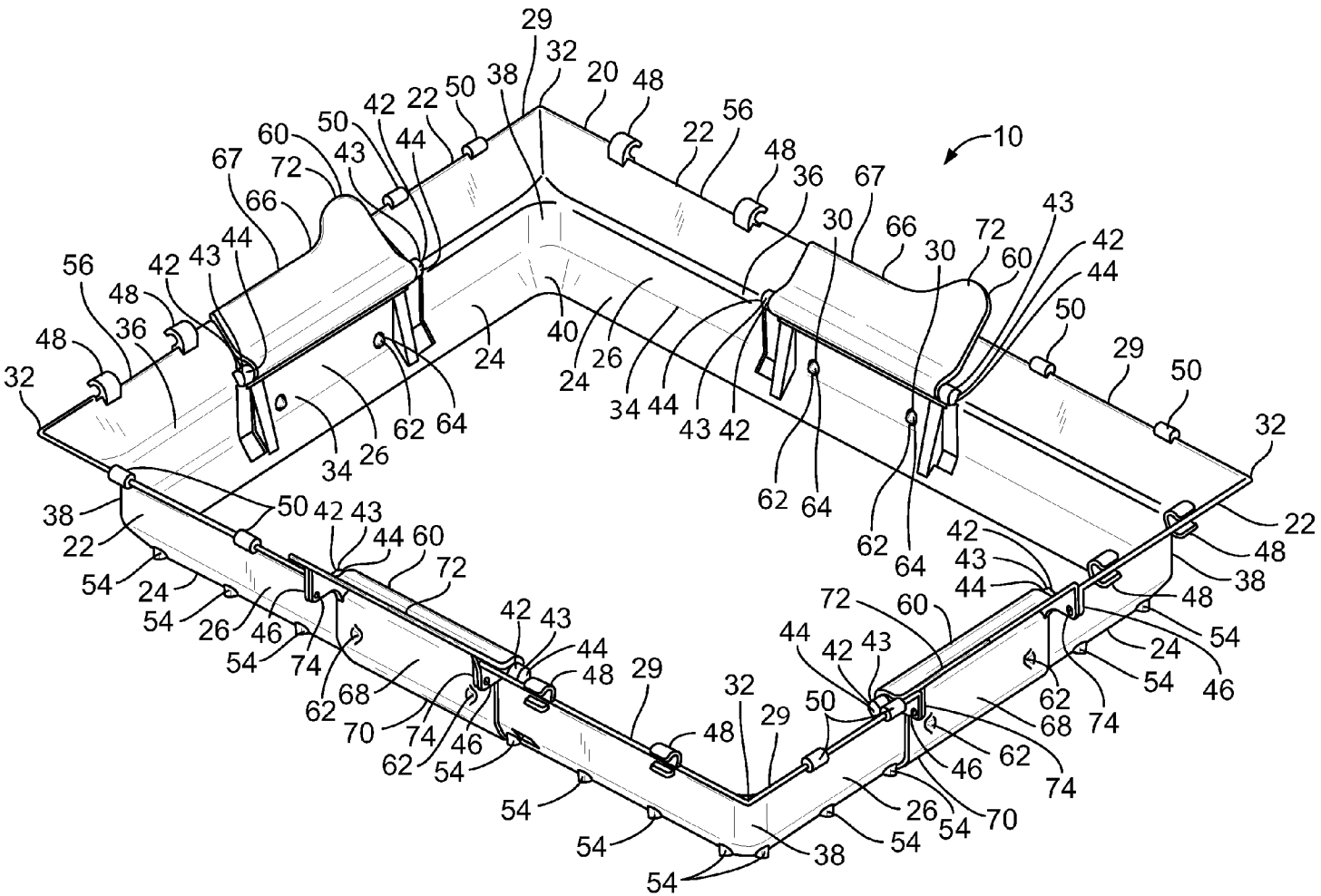
FIG. 1A is a perspective view of one embodiment of a lawn bag apparatus.
Figure 1B:
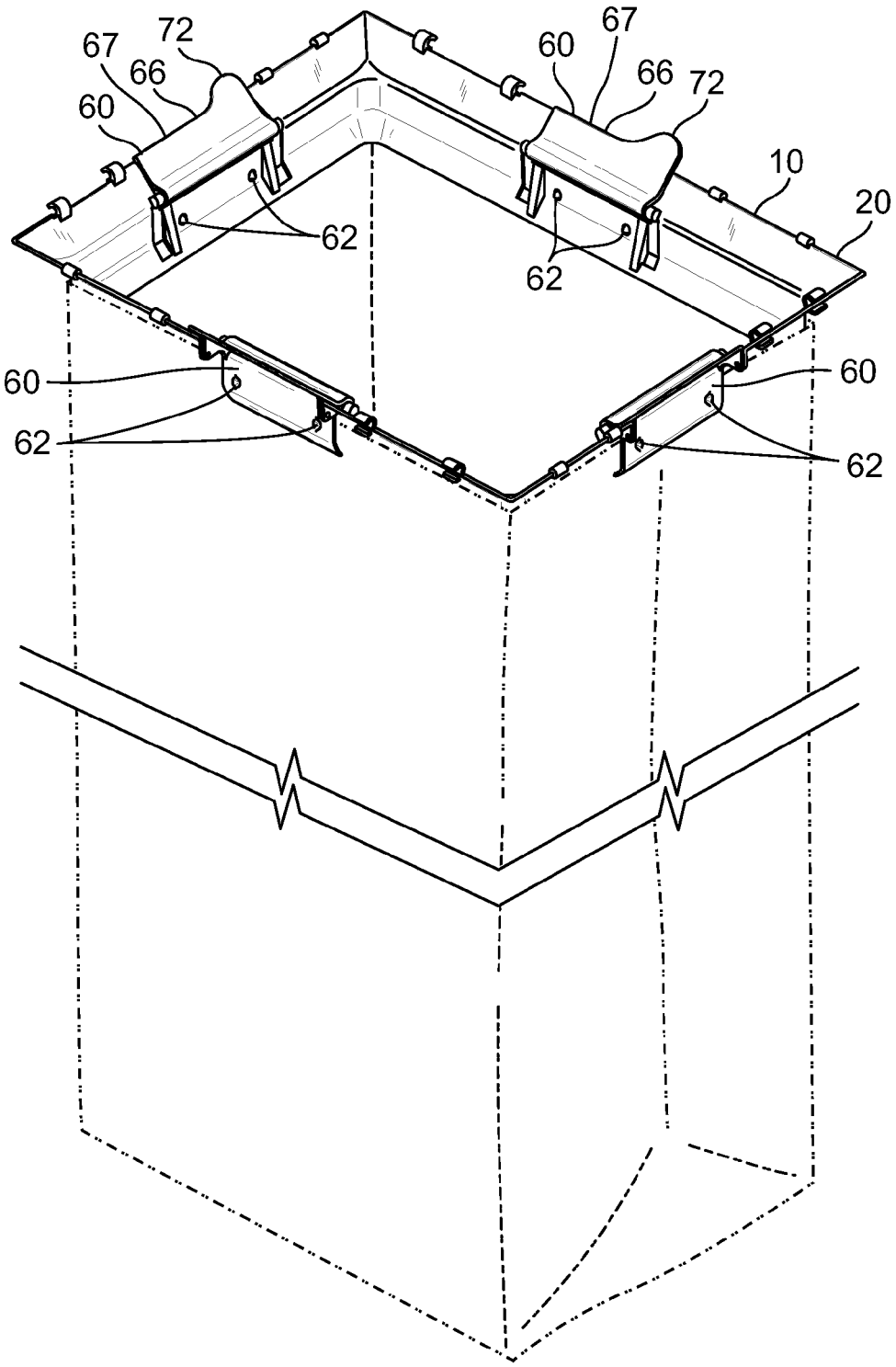
FIG. 1B is a perspective view of the lawn bag apparatus of FIG. 1A shown installed on a representative lawn bag.
Figure 2:
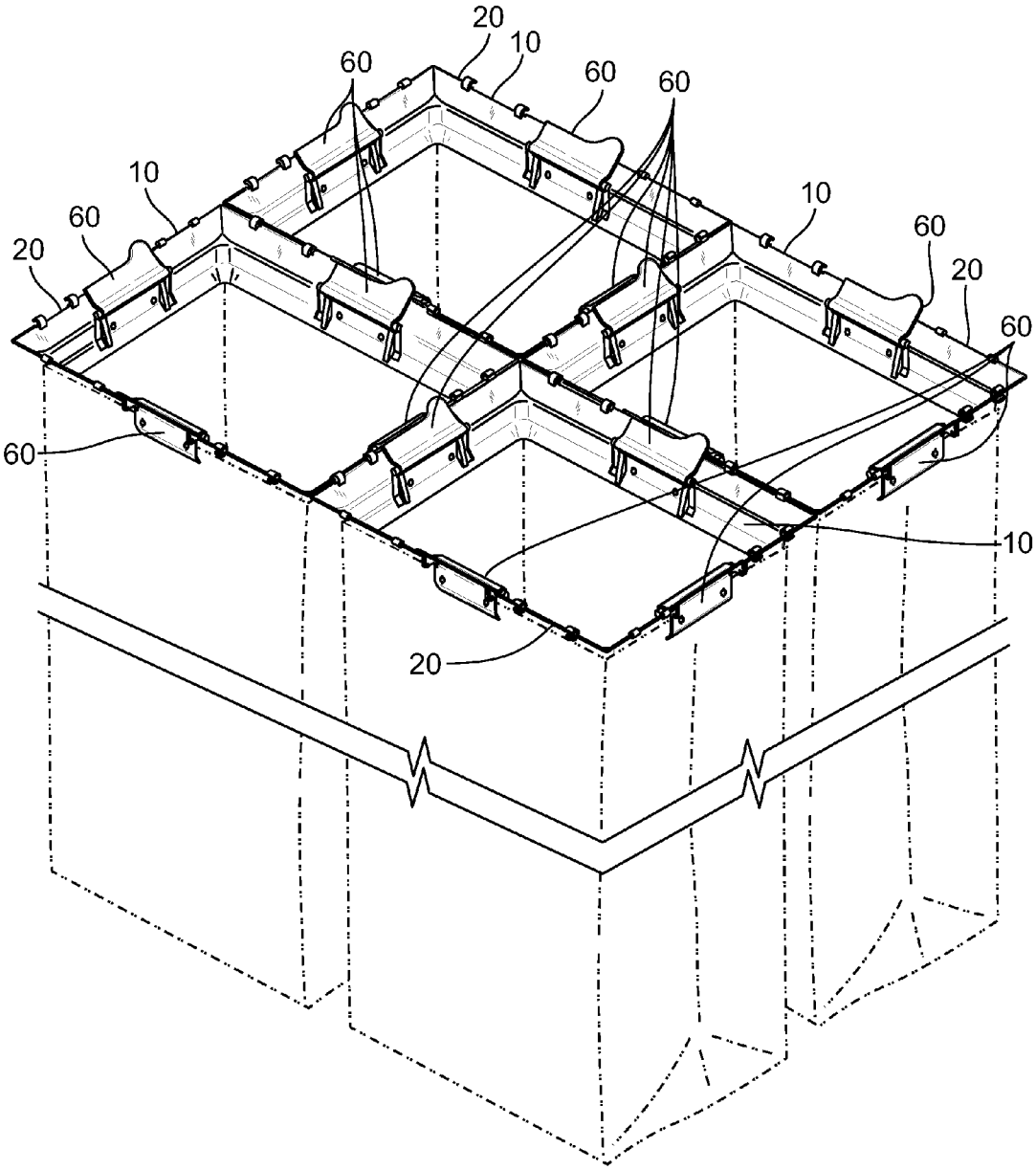
FIG. 2 is a perspective view of a multiple of lawn bag apparatus of FIG. 1A coupled together.

Although the figures and the instant disclosure describe one or more embodiments of a lawn bag apparatus, one of ordinary skill in the art would appreciate that the teachings of the instant disclosure would not be limited to such uses.

At the outset, it has been discovered by the inventor of the instant disclosure that attaching a lawn bag apparatus to the opening of a conventional paper lawn bag may stabilize the opening, may maintain the opening to approximately its maximum open area, and may also provide resistance to buckling of a sidewall of the bag. Even if a sidewall of the bag buckles below the lawn bag apparatus, the opening may tend to remain in its opened state thereby assisting a consumer to manage the task of loading the bag with debris by not having to also address the issue of the collapsed opening. Moreover, coupling several lawn bag apparatus/bag systems together may provide further stability and resistance to buckling of any individual bag in the system through load sharing across multiple bags. Thus, even if one bag exceeds its buckling load, the coupled others may not, in which case, the coupled others may assist the buckled bag to remain standing upright to permit continued loading of lawn and garden debris in the coupled bags. Use of a lawn bag apparatus in connection with a conventional paper lawn bag may be counterintuitive because, as described more fully below, the frame may add weight to the opening and may be positioned well above the center of gravity of the bag, which may decrease the load margin to buckle the sidewall of the bag.

Turning now to the figures, wherein like reference numerals refer to like elements, there is shown an exemplary lawn bag apparatus 10 that provides rigidity and stabilization to the open end of a paper lawn bag to ease the insertion of lawn and garden debris into the bag. Lawn bag apparatus 10 comprises frame 20 having sidewalls 22 arranged to approximate the opening of the bag. In the embodiments shown in the figures, each of sidewalls 22 of frame 20 includes a lower wall portion 24, a midwall portion 26, and an upper wall portion 28. Sidewalls 22 may alternatively be configured using only upper wall portion 28 and middle wall portion 26 if desired. From one end to the other, sidewalls 22 may be approximately straight, as shown in the figures. One or more of sidewalls 22 may alternatively be curved.

As best shown in FIGS. 1A, 5A-5B, 6A, 10A-10B, and 11, lower wall portion 24 of each sidewall 22 may be sloped downwardly and inwardly relative to the opening of the bag. Midwall portion 26 of each sidewall 22 is connected to lower wall portion 24 and may be arranged approximately upwardly and vertically from lower wall portion 24. In one embodiment, midwall portion 26 extends upwardly from an upper edge of lower wall portion 24. In another embodiment, lower wall portion 24 extends downwardly and inwardly from a lower edge of midwall portion 26. Upper wall portion 28 of each sidewall 22 is connected to midwall portion 26 and may be sloped upwardly and outwardly from midwall portion 26. In one embodiment, upper wall portion 28 extends upwardly and outwardly from an upper edge of midwall portion 26. When viewed in a cross section, the profile of the inner face of lower wall portion 24, midwall portion 26 and upper wall portion 28 may be at least one of approximately flat, approximately concave, or approximately convex from the upper edge to the lower edge while permitting the slope or orientation described above. In one aspect, at least one of lower portion 24, midwall portion 26, and upper wall portion 28 may be configured to deflect debris into the bag.

Fillet 34 may form the transition between lower wall portion 24 and midwall portion 26, and transition 36, which may be rounded, may form the intersection of midwall portion 26 to upper wall portion 28. Adjoining upper wall portions 28 of frame 20 may include corners 32 for purposes explained more fully below. Fillet 38 may form the transition between adjoining midwall portions 26 of frame 20. Fillet 40 may form the transition between adjoining lower wall portions 24 of frame 20.

To clasp the lawn bag near its opening and to removably secure frame 20 to the lawn bag, frame 20 may include clamps positioned along two or more sidewalls 22, each clamp having grip 62 for gripping the bag. In one embodiment, a clamp may be positioned along two opposite sidewalls 22. In another embodiment, a clamp may be positioned along each of sidewalls 22. In the embodiments shown in the figures, frame 20 is shown as including clamps 60,80,100 positioned on each sidewall 22. Clamps 60,80,100 may include a handle, such as handle portion 66,86,106, to help a consumer grasp and articulate clamps 60,80,100. Clamps 60,80,100 may be articulated back and forth to and from an open, disengaged position (as shown, for example, in FIGS. 5B and 10B) and a closed, engaged position (as shown, for example, in FIGS. 5A and 10A) with the bag. In one embodiment, clamps 60,80,100 may be rotated back and forth to and from an open, disengaged position and a closed, engaged position with the bag. Clamps 60,80,100 may also include middle wall portion 68,88,108 having grip 62 thereon. Clamps 60,100 may further include bottom wall portion 70,110. As shown in FIGS. 4A-4B and 9A-9B, when articulated into the closed, engaged position, handle portion 66,86,106 of clamps 60,80,100 may generally align with upper wall portion 28 of sidewall 22. In one aspect, clamps 60,80,100 form a portion of sidewall 22 to deflect debris into the bag. As shown in FIGS. 6A-6B, clamp 80 may include rib 96 for strengthening middle wall portion 88.

Figure 5A:
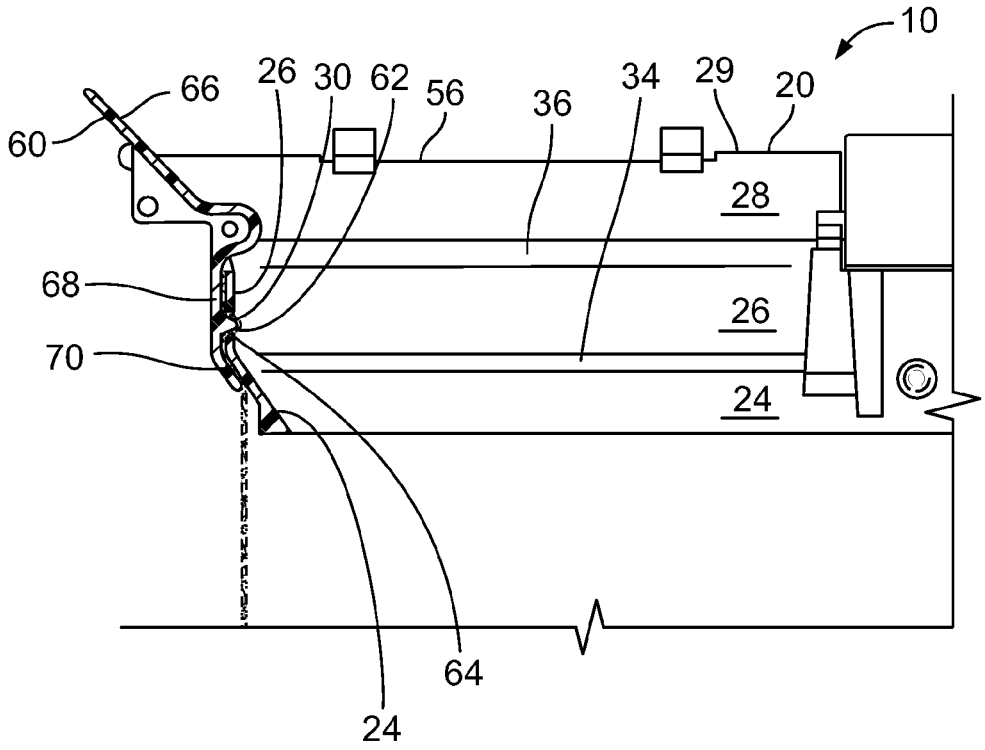
FIG. 5A is a cross sectional view of the lawn bag apparatus of FIG. 4A.
Figure 5B:
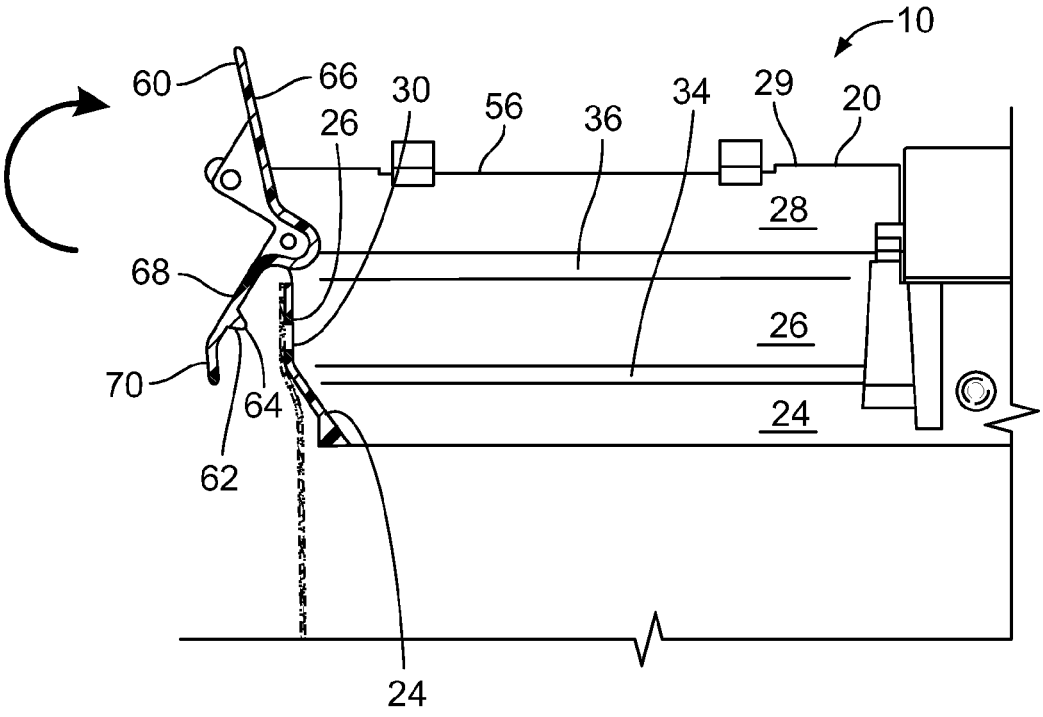
FIG. 5B is a cross sectional view of the lawn bag apparatus of FIG. 4B.
Figure 6A:
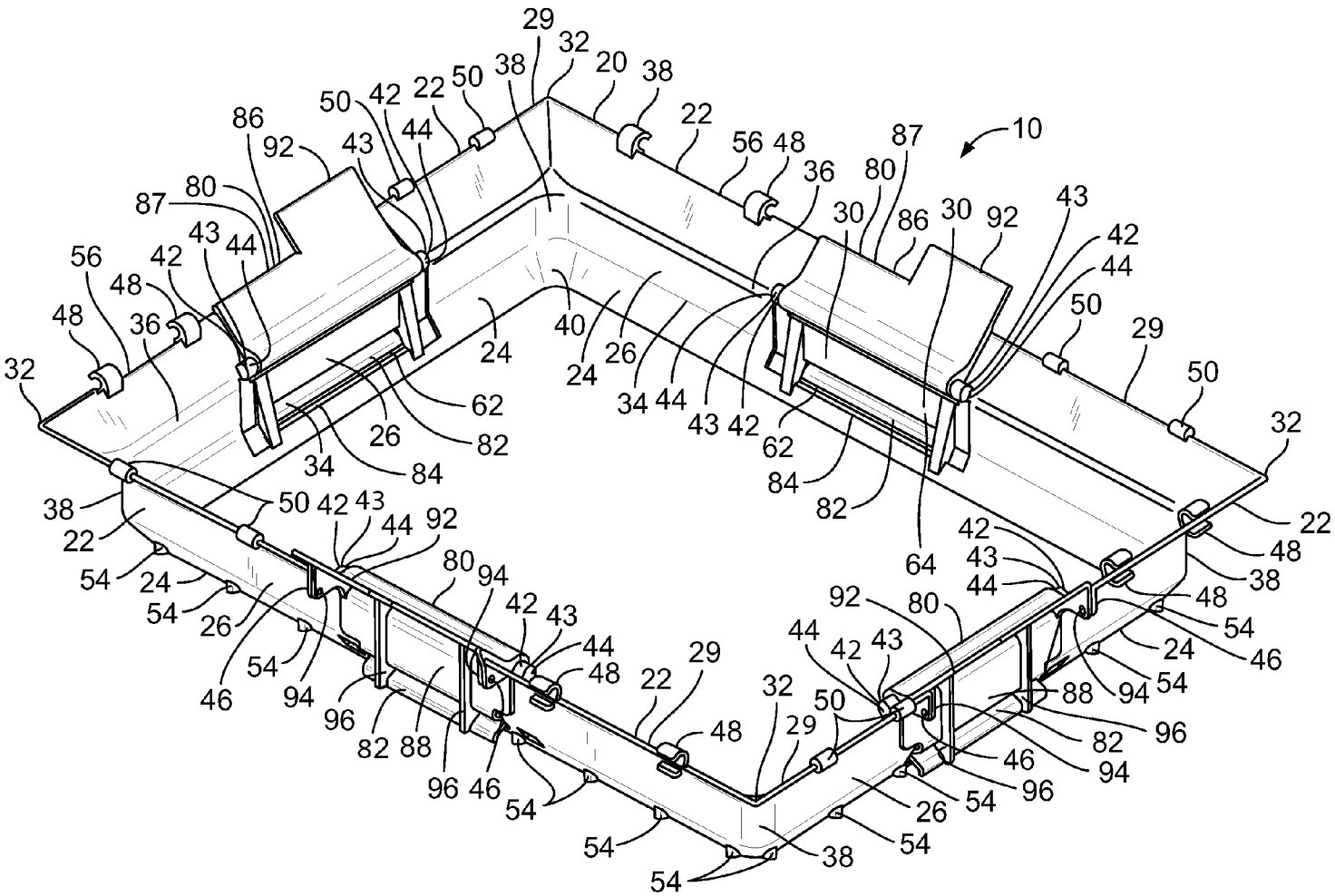
FIG. 6A is a perspective view of another embodiment of a lawn bag apparatus.
Figure 6B:
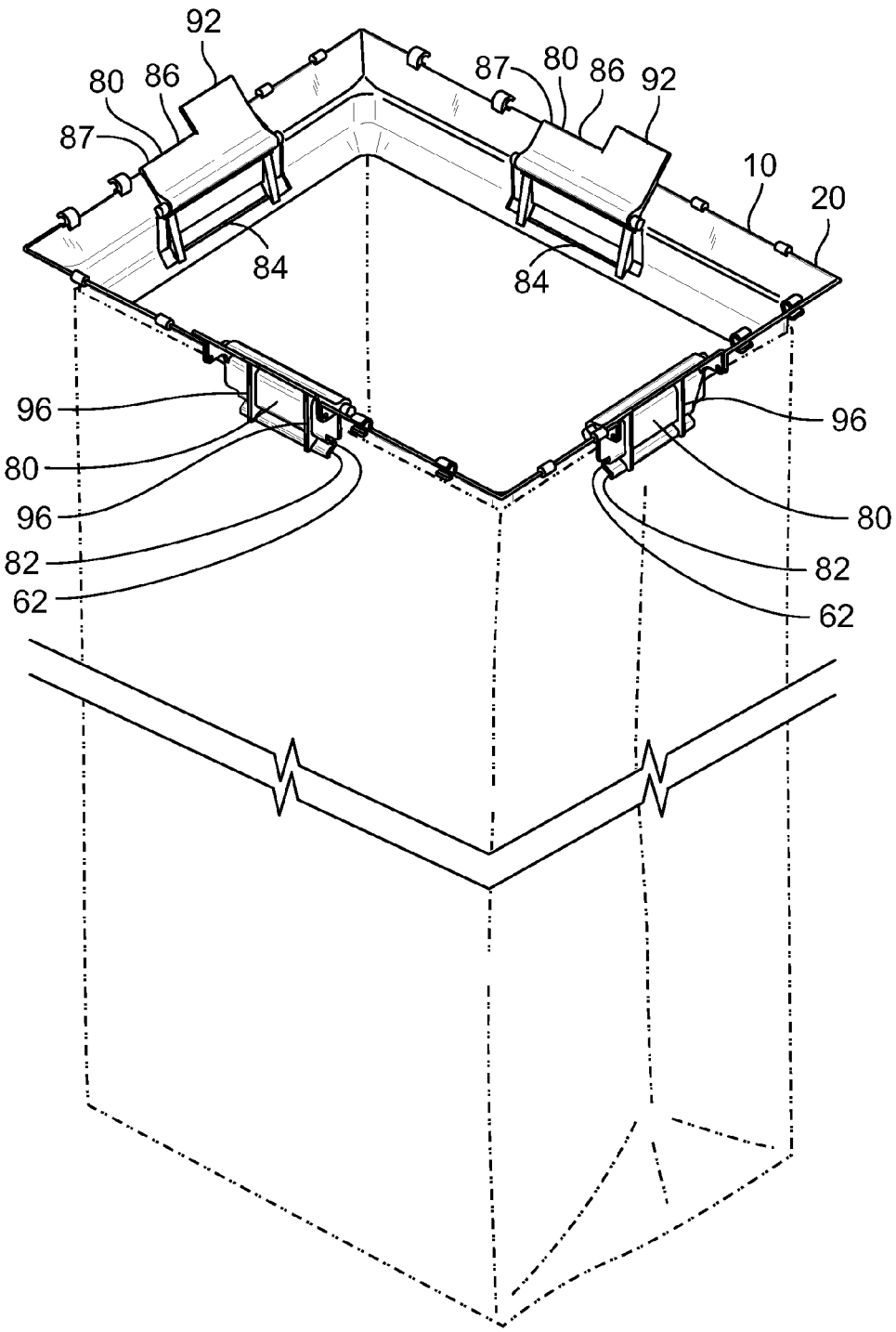
FIG. 6B is a perspective view of the lawn bag apparatus of FIG. 6A shown installed on a representative lawn bag.
Figure 7:
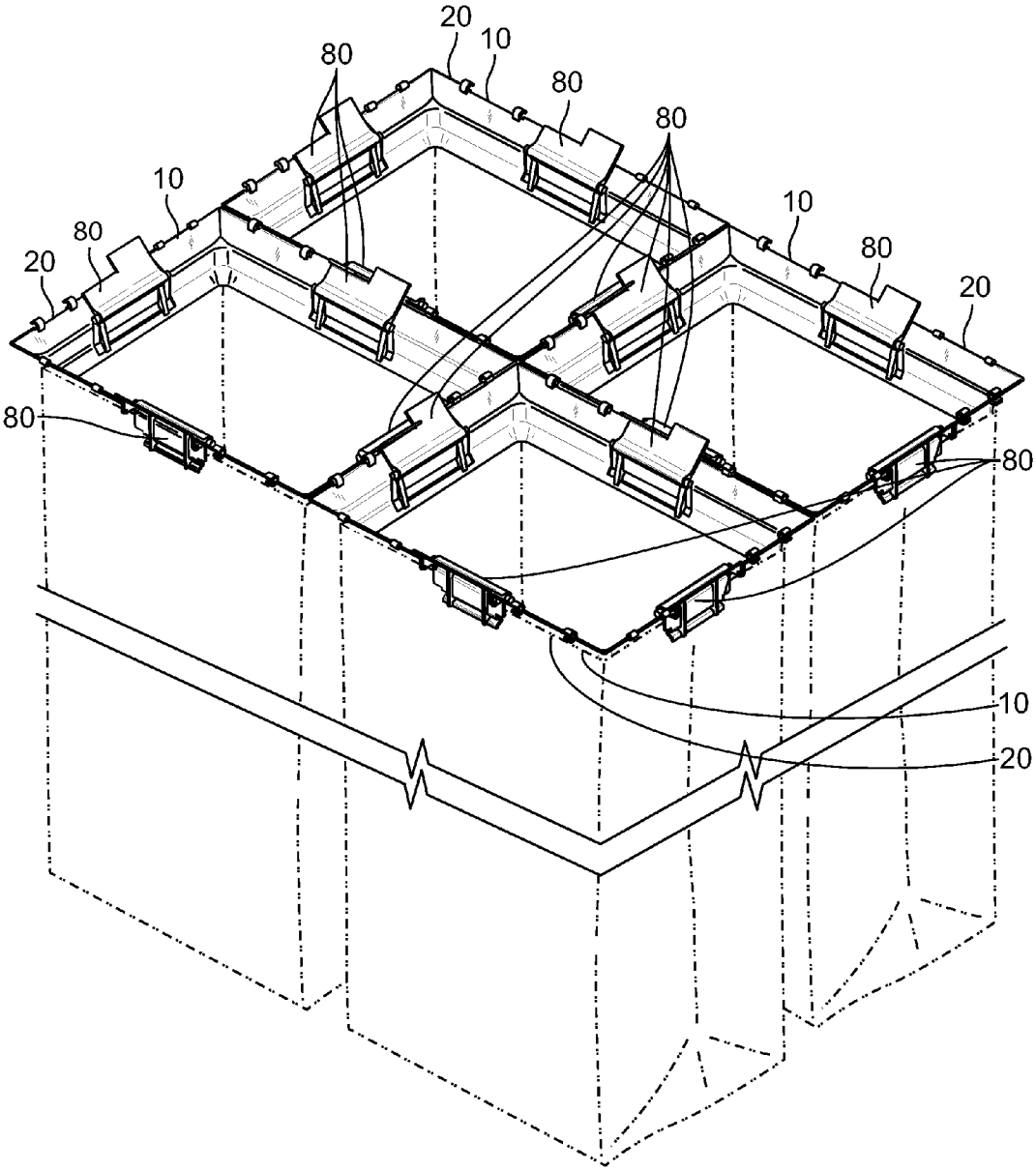
FIG. 7 is a perspective view of a multiple of lawn bag apparatus of FIG. 6A coupled together.
Figure 10A:
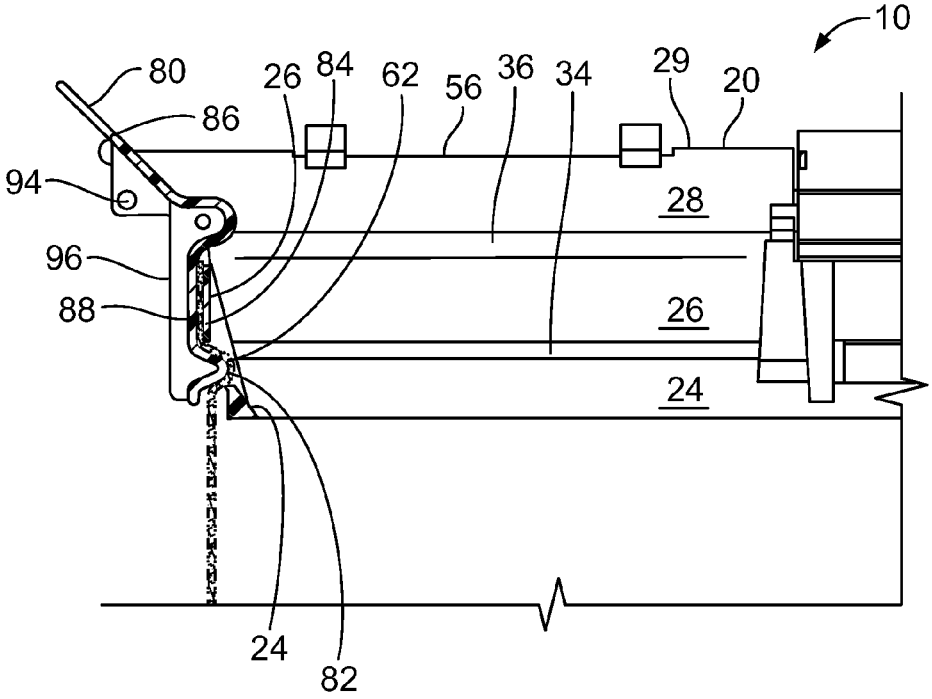
FIG. 10A is a cross sectional view of the lawn bag apparatus of FIG. 9A.
Figure 10B:
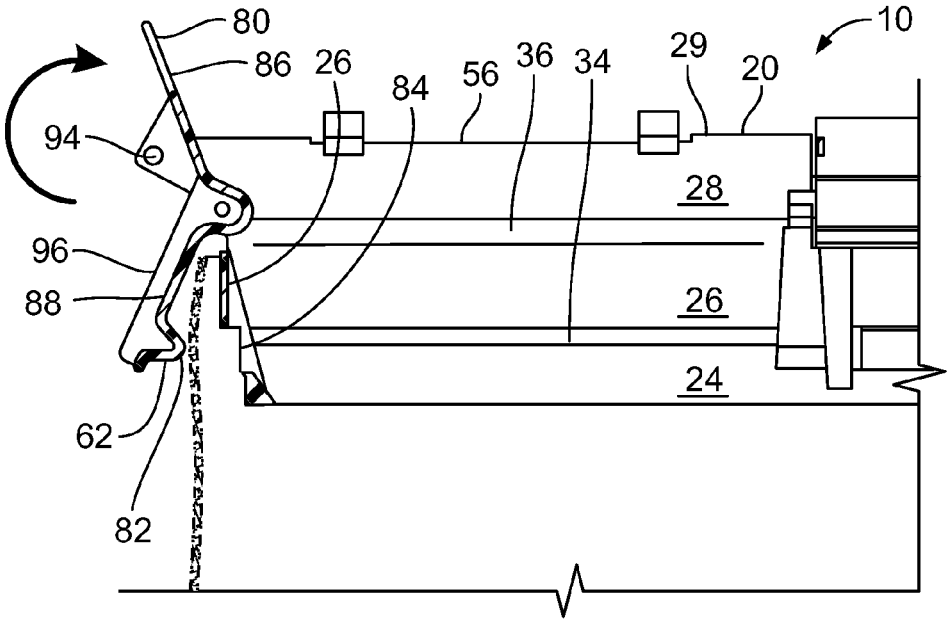
FIG. 10B is a cross sectional view of the lawn bag apparatus of FIG. 9B.

To permit clamps 60,80,100 to articulate from an open, disengaged position (as shown in FIGS. 5B and 10B) to a closed, engaged position (as shown in FIGS. 5A and 10A), lawn bag apparatus 10 may include pivot 42 comprising receiving portion 43 and male portion 44. Receiving portion 43 may comprise a socket positioned on sidewalls 22 of frame 20. Male portion 44 may comprise a protrusion positioned on clamps 60,80,100. Male portion 44 may alternatively be positioned on sidewalls 22 and receiving portion 43 may be positioned on clamps 60,80,100.

To maintain clamps 60,80,100 in a closed, engaged position, sidewall 22 of frame 20 may include nub 46 corresponding to recess 74,94,114, which may be sized and configured to capture nub 46 and/or act as a detent when clamps 60,80,100 are rotated into the closed, engaged position. Clamps 60,80, 100 may additionally or alternatively be spring loaded and biased by the spring in the closed, engaged position to help ensure that frame 20 remains engaged with the bag.

Grip 62 of clamps 60,80,100 may be formed in any configuration to hold lawn bag apparatus 10 and the lawn bag together during use. To couple lawn bag apparatus 10 to the bag, grip 62 may include one or more protrusions 64 configured for piercing and protruding through the bag wall and for nesting with apertures 30 in sidewall 22 of frame 20. In FIGS. 1A-5B and 11, for example, grip 62 of clamps 60,100 is shown as having a pair of protrusions 64 for piercing the bag wall. Protrusions 64 may be conical (as shown in the figures), cylindrical, or any shape that matches the shape of aperture 30. Protrusions 64 may be formed or cast as one piece with clamps 60,100. In another embodiment, as shown in FIGS. 6A-10B, grip 62 of clamp 80 comprises linear protrusion 82 configured for nesting with slot 84 in sidewall 22 of frame 20 to increase friction between the bag and lawn bag apparatus 10. In yet another embodiment, grip 62 may comprise a plurality of ribs, ridges, or knurling to increase friction between clamp 60,80,100 and the bag. In another embodiment, clamps 60,80,100 may comprise a roll pin affixed to an inner wall of clamps 60,80,100 and oriented perpendicularly to the bag to pierce the bag when clamps 60,80,100 are rotated into the closed, engaged position. Together with the available sheer strength of the lawn bag wall, piercing the lawn bag with the one or more protrusions 64 and coupling lawn bag apparatus 10 to the lawn bag as described above allows a consumer to pick up or move the lawn bag, filled with debris or empty, by handling or manipulating lawn bag apparatus 10. A consumer may, via lawn bag apparatus 10, lift or move a lawn bag filled with at least 30 lbs of material.

Turning now to FIGS. 2-3, 7-8, and 13, lawn bag apparatus 10 may be coupled to one or more additional lawn bag apparatus 10 to permit loading of a substantial amount of lawn and yard debris at one time. To couple multiple lawn bag apparatus 10 together, each sidewall 22 of frame 20 may include spaced apart male and female portions to form snap joint 52 (see FIGS. 3 and 8, for example). When one frame 20 is brought in aligned proximity to one another frame 20, respective male portions on one frame 20 may be aligned with and captured by respective female portions on the adjacent frame 20 and vice versa. A consumer may apply pressure to seat each respective male portion on one frame 20 with the corresponding female portion on the adjacent frame 20 and vice versa. A plurality of frames 20 may be coupled together in this manner to form an array of frames, as shown in the exemplary illustrations in FIGS. 2-3, 7-8, and 13. Reversing the process permits a consumer to separate frame 20 from one or more other frames 20.

Figure 3:
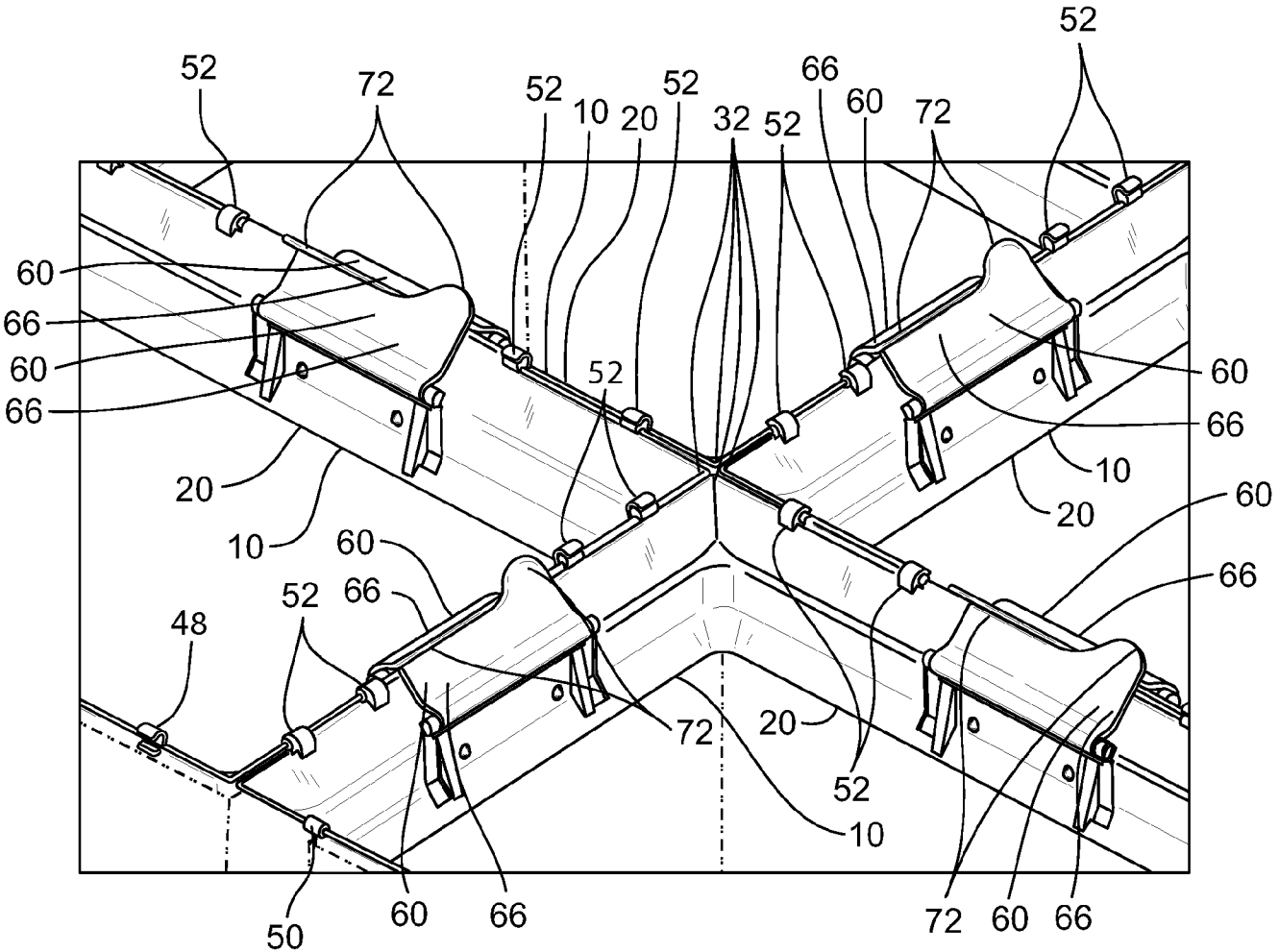
FIG. 3 is a detailed perspective view of the lawn bag apparatus shown in FIG. 2.
Figure 4A:
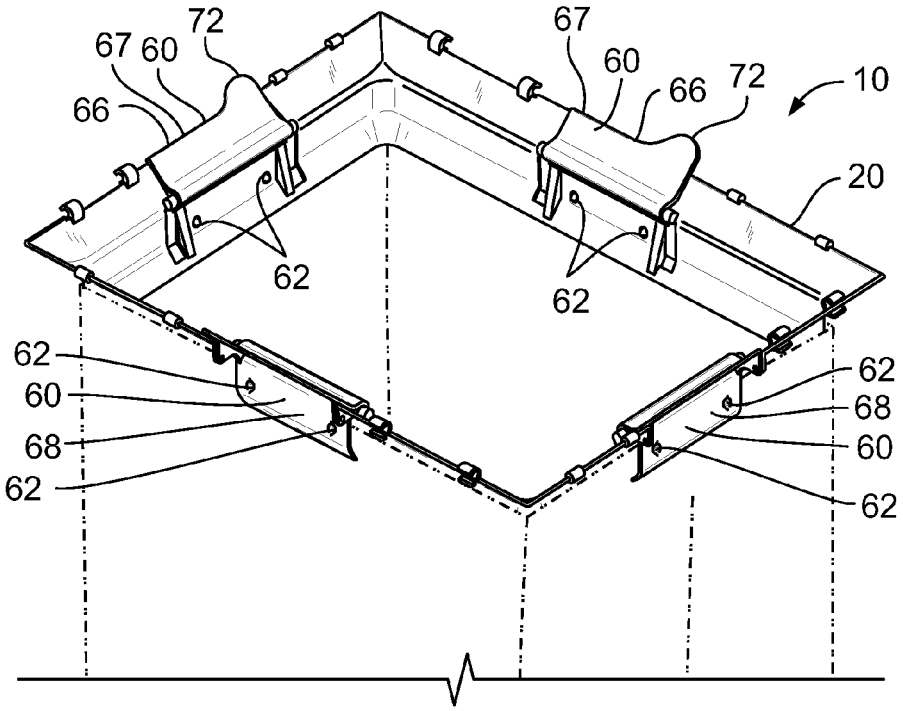
FIG. 4A is a perspective view of the lawn bag apparatus of FIG. 1A with the clamps in a closed, engaged position with a representative lawn bag.
Figure 4B:
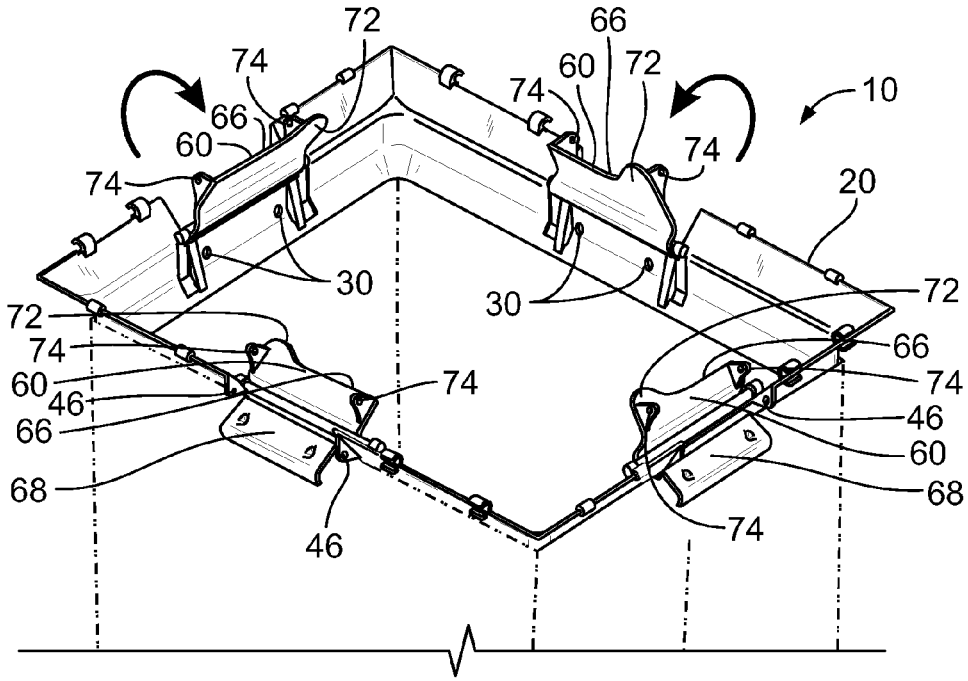
FIG. 4B is a perspective view of the lawn bag apparatus of FIG. 1A shown with the clamps in the open, disengaged position with a representative lawn bag.
Figure 8:
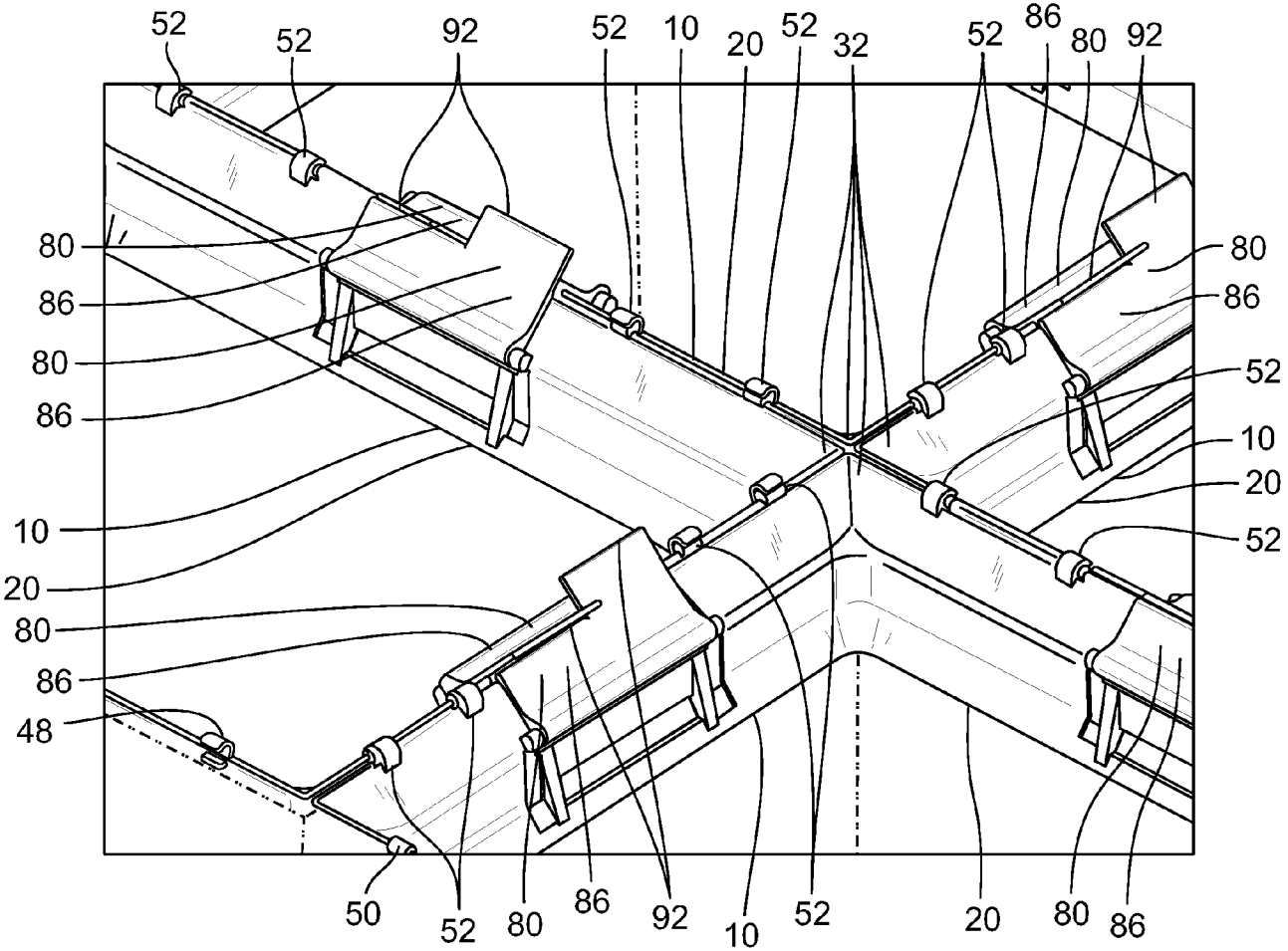
FIG. 8 is a detailed perspective view of the lawn bag apparatus shown in FIG. 7.
Figure 9A:
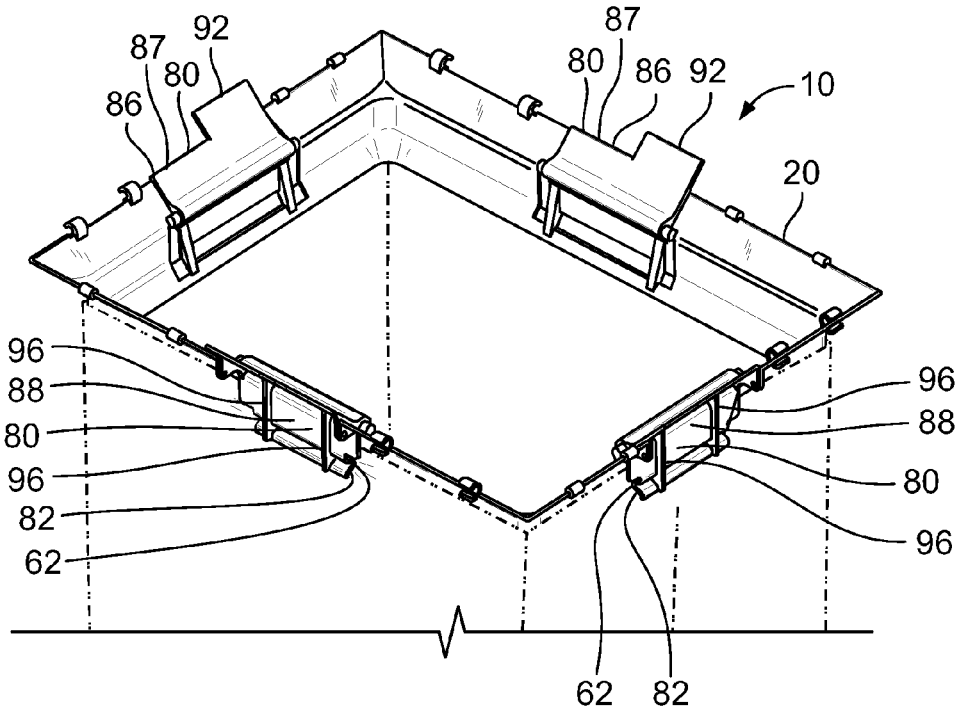
FIG. 9A is a perspective view of the lawn bag apparatus of FIG. 6A with the clamps in a closed, engaged position with a representative lawn bag.
Figure 9B:
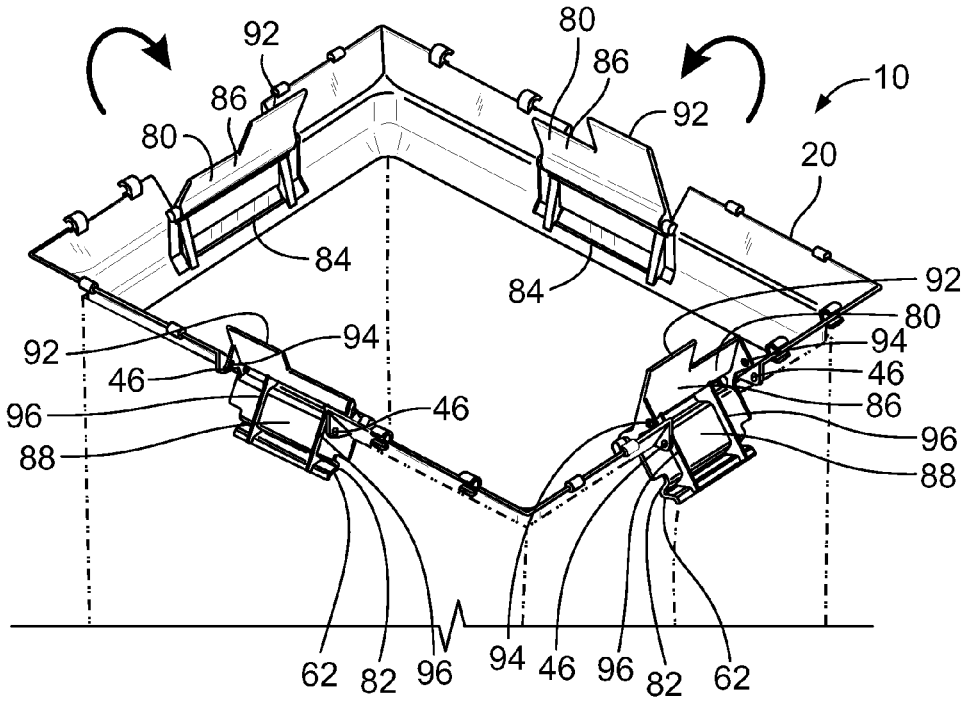
FIG. 9B is a perspective view of the lawn bag apparatus of FIG. 6A shown with the clamps in the open, disengaged position with a representative lawn bag.
Figure 11:
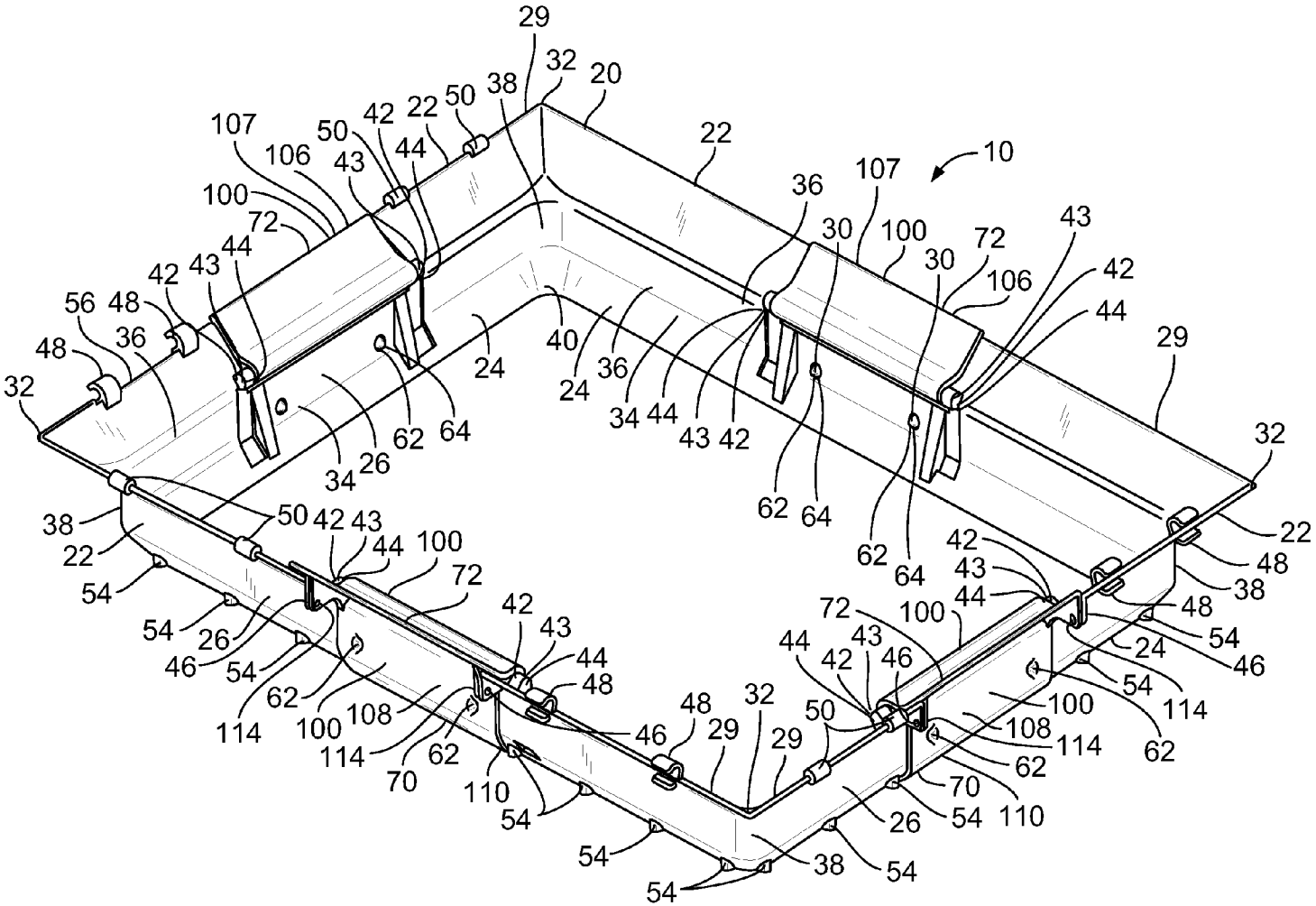
FIG. 11 is a perspective view of another embodiment of a lawn bag apparatus.
Figure 12:
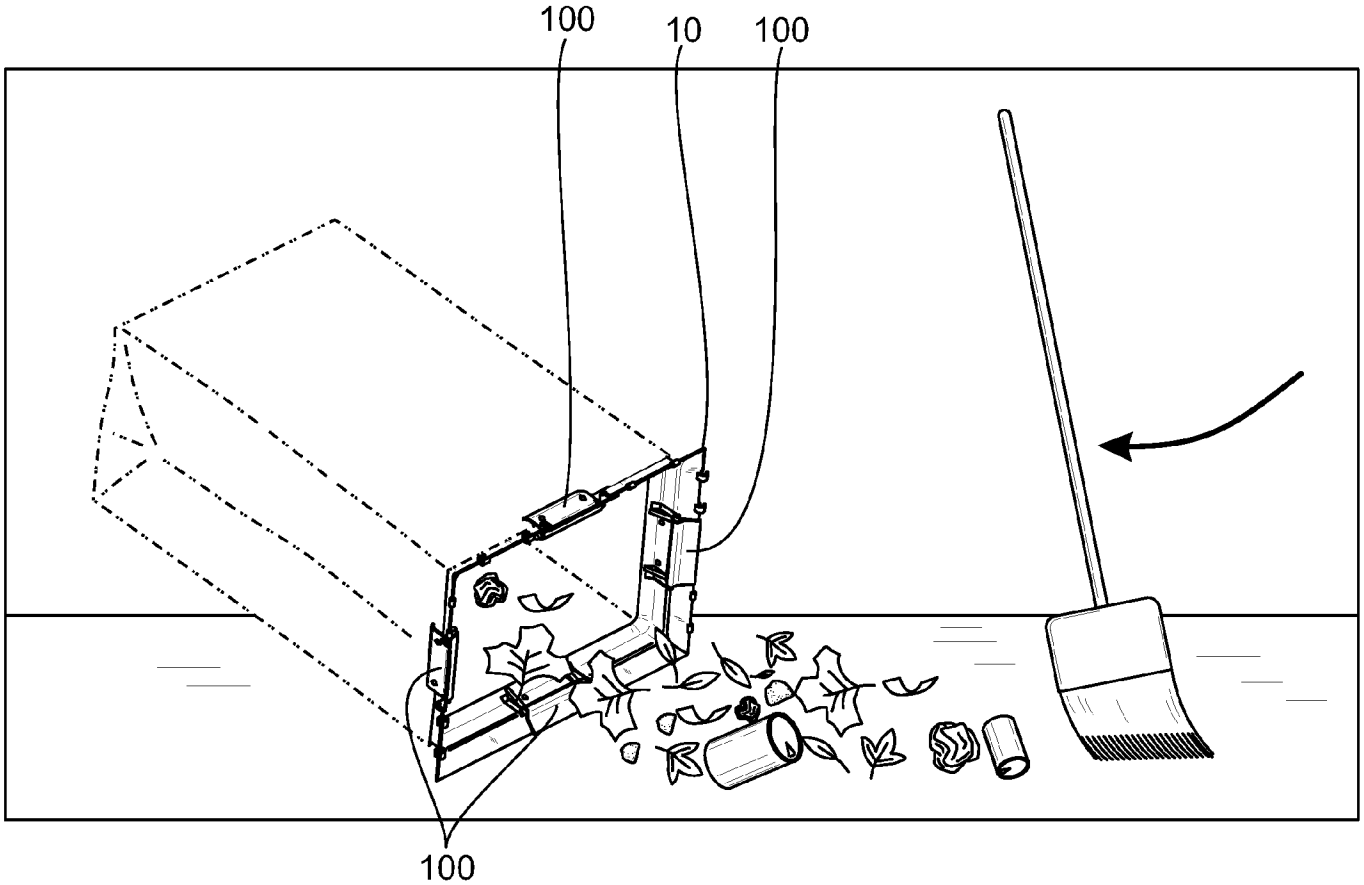
FIG. 12 shows the lawn bag apparatus of FIG. 11 in a representative position for use.
Figure 13:
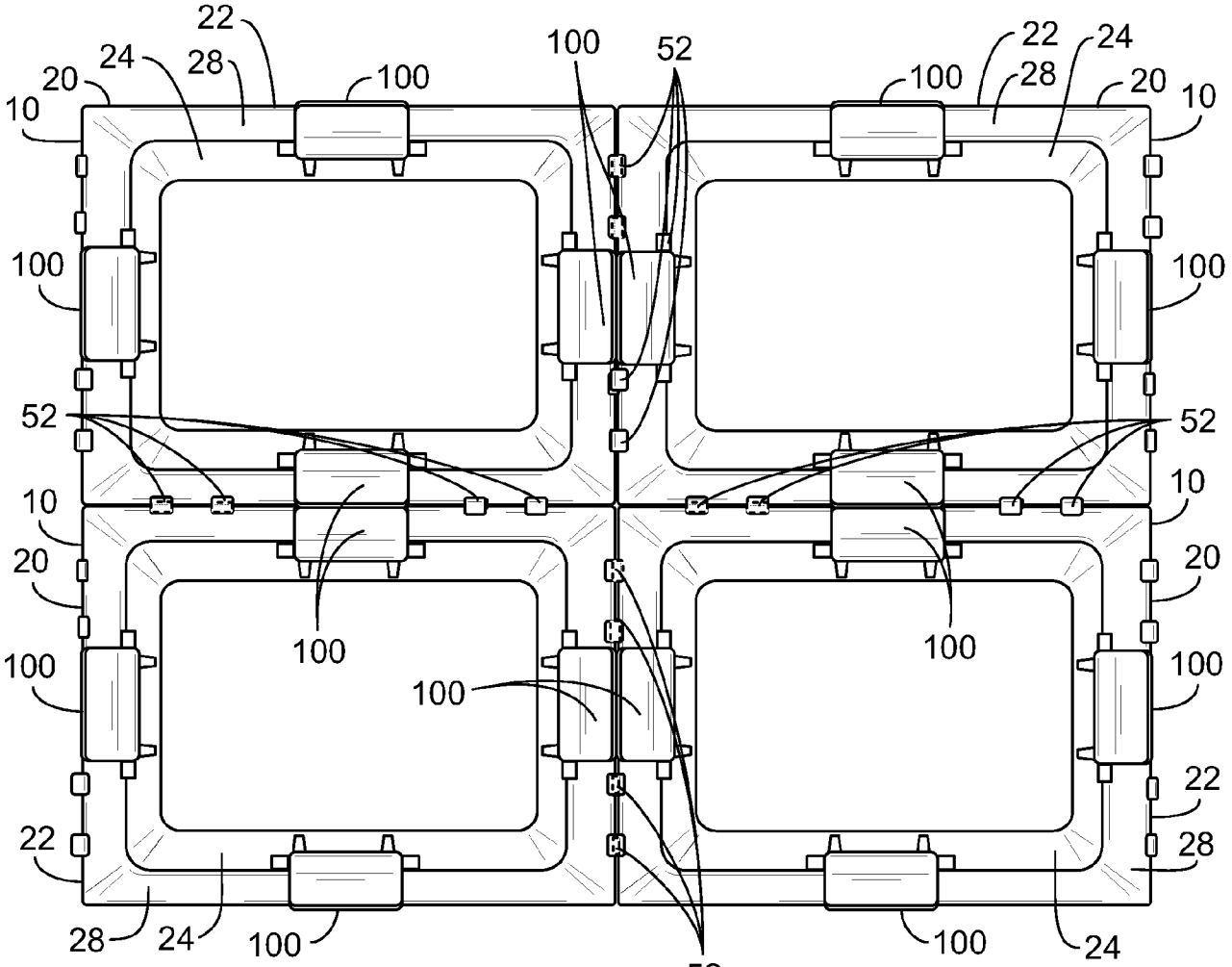
FIG. 13 is a top plan view of a multiple of lawn bag apparatus of FIG. 11 coupled together.

More particularly, as shown in FIGS. 1A, 6A and 11, sidewalls 22 of frame 20 may include a pair of spaced apart snap receivers 48 arranged along the upper edge of sidewall 22 on one side of clamp 60,80,100, and a pair of spaced apart snap nubs 50 arranged along the upper edge of sidewall 22 on the other side of clamp 60,80,100. A fewer or greater number of snap receivers 48 and snap nubs 50 may be employed and in any order or spacing. To permit upper wall portion 28 to act as a dustpan when lied on a flat surface, such as a garage floor or a driveway, at least one sidewall 22 of frame 20 may be free of any snap receivers 48 and snap nubs 50, as shown in the embodiment of FIGS. 11-13, so that top edge 29 of upper wall portion 28 may lie approximately flush to the flat surface. Top edge 29 may also include relief 56 between and/or in the vicinity of snap receivers 48 to provide clearance for ease of assembly of adjacent sidewalls 22 of adjacent frames 20. To help ensure that debris is directed to the interior of the one or more bags, snap receivers 48 and snap nubs 50 may be arranged in predetermined locations along sidewall 22 to position corners 32 of adjacent frames 20 to lie in proximity with one another, as best shown in FIGS. 3, 8 and 13.

Clamps 60,80,100 may include an extended portion, such as extended portions 72,92 shown in FIGS. 1A-10B, to assist a consumer to grab and articulate clamps 60,80,100. Extended portions 72,92 may be any shape or size, and are shown in the figures as being rounded or square for reference only. Clamps 60,80,100 may alternatively be configured without any extended portion on at least one sidewall 22, as shown in FIGS. 11-13. In this way, top edge 67,87,107 of handle portion 66,86,106 may lie approximately aligned with top edge 29 of upper wall portion 28 of sidewalls 22 of frame 20. Clamps 60,80,100 may then work together with top edge 29 of sidewall 22 of frame 20 to permit lawn bag apparatus 10 to act as a dustpan on a flat surface, as described above. As shown in FIG. 12, with top edge 67,87,107 of handle portion 66,86,106 of clamps 60,80,100 approximately aligned with top edge 29 of at least one sidewall 22, a consumer may lie lawn bag apparatus 10 and the bag to which it is secured lengthwise toward or on the ground to cause upper wall portion 28 of frame 20 to lie on or near the ground and may use upper wall portion 28 of sidewall 22 of frame 20 as a ramp to scoop debris into the bag. Clamps having different configurations or features from one another, such as type of grip 62 or existence of extended portions 72,92, may be interchangeably attached to sidewalls 22 of frame 20.

As shown in FIGS. 2-3 and 7-8, if any clamp 60,80,100 includes an extended portion, such as extended portions 72,92, the extended portion may be configured to lie beside an adjacent extended portion to avoid interfering with one another when clamps 60,80,100 are articulated to the closed, engaged position.

Lawn bag apparatus 10 may be fabricated to minimize weight, maximize strength and rigidity, and minimize cost to the consumer. Lawn bag apparatus 10 may be made from one or more types of materials, such as polyethylene, high density polyethylene, polypropylene, ABS, nylon, and recycled polymers including post-consumer resin (PCR). The material used to fabricate lawn bag apparatus 10 may include approximately 10% glass filled fiber. Glass filled fiber or other additives may be included in varying amounts depending on the balance of cost and desired rigidity of the finished product. Lawn bag apparatus 10 may range in weight from approximately 0.5 lbs or less to approximately 0.75 lbs or more depending on the actual stiffness of the wall of the lawn bag and the desired design margin to buckling bag wall. Lawn bag apparatus 10 may be lighter or heavier depending on the selection of materials used in fabricating lawn bag apparatus 10, as well as the stiffness of the lawn bag walls.

Sidewalls 22 of frame 20 may be formed or cast as one piece with one another. Sidewalls 22 may alternatively be separate pieces that are joined to form frame 20. Sidewalls 22 may be formed from a plastic using an injection molded process. For ease of manufacture if an injection molded process is employed, sidewalls 22 of frame 20 may include standoffs 54 that are spaced and positioned to permit uniform and quick ejection of sidewalls 22 from a mold. Clamp 60,80,100 may also be fabricated from a plastic using an injected molding method. Frame 20 or clamps 60,80,100 or both may alternatively be fabricated using any technique or materials, such as a composite material. Exemplary composite materials include those made of carbon fiber or fiberglass. Use of a composite material may provide a lightweight and deflection and torsion resistant structure.

Lawn bag apparatus 10 may be sized to be inserted inside the opening of the bag and rest on the edge of the opening to provide an opportunity for the consumer to engage clamps 60,80,100 of the frame 20 with the bag. To secure lawn bag apparatus 10 to a lawn bag, with clamps 60,80,100 configured in the open position, a consumer may at least partially insert frame 20 into the bag opening by inserting lower wall portion 24 and at least a portion of midwall portion 26 into the opening. Lawn bag apparatus 10 may rest on the top edge of the bag underneath clamps 60,80,100. A consumer may then articulate clamps 60,80,100 into the closed, engaged position with the bag. In doing so, grip 62 of clamp 60,80,100 may frictionally grip or pierce the bag wall to secure the bag to frame 20. As shown in FIGS. 5A and 10A, after clamps 60,80,100 are articulated into the closed, engaged position, the bag wall may lie between clamps 60,80,100 and external surfaces of at least midwall portion 26 and lower wall portion 24, respectively, of sidewall 22. In the absence of a bag, when clamps 60,80,100 are articulated into the closed position, middle wall portion 68,88,108 (and bottom wall portion 70,110) of clamps 60,80,100 may nest with external surfaces of midwall portion 26 and lower wall portion 24, respectively, of sidewall 22 to present a cohesive and unobtrusive appearance to the consumer.

In one method of use, multiple units of lawn bag apparatus 10 may be secured to respective lawn bags in the manner described above. A consumer may then couple adjacent frames 20 of adjacent lawn bag apparatus 10 by bringing together respective snap receivers 48 and snap nubs 50 to form snap joints 52. In another method of use, multiple units of lawn bag 10 may be secured together at snap joints 52, then secured to respective lawn bags by articulating clamps 60,80,100 to the closed, engaged position with the bag.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A lawn bag apparatus to stabilize an opening of a lawn bag, comprising:

a frame comprising a plurality of sidewalls arranged to approximate the opening, each sidewall comprising a midwall portion extending approximately vertically, an upper wall portion extending upwardly and outwardly from the midwall portion, and a lower wall portion extending downwardly and inwardly from the midwall portion; and a first clamp positioned along one of the sidewalls and a second clamp positioned along another of the sidewalls opposite the first clamp, the first and second clamps being movable between an open, disengaged position and a closed, engaged position for detachably securing the frame to the lawn bag, wherein the first and second clamps comprise a grip for attaching the lawn bag apparatus to the lawn bag.

2. The lawn bag apparatus of claim 1, wherein the grip comprises a protrusion for piercing and protruding through a wall of the lawn bag.

3. The lawn bag apparatus of claim 2, wherein the sidewall nearest the protrusion comprises an aperture for receiving the protrusion.

4. A lawn bag apparatus to stabilize an opening of a lawn bag, comprising:

a frame comprising a plurality of sidewalls arranged to approximate the opening, each sidewall comprising a midwall portion extending approximately vertically, an upper wall portion extending upwardly and outwardly from the midwall portion, and a lower wall portion extending downwardly and inwardly from the midwall portion; and a first clamp positioned along one of the sidewalls and a second clamp positioned along another of the sidewalls opposite the first clamp, the first and second clamps being movable between an open, disengaged position and a closed, engaged position for detachably securing the frame to the lawn bag, wherein a plurality of frames are joined together side by side to form an array of frames for stabilizing the opening of an array of lawn bags, wherein each of the plurality of frames comprises a plurality of male members and a plurality of receivers positioned on adjacent sidewalls of adjacent frames for joining adjacent frames together, the receivers configured to detachably connect with the male members positioned on adjacent sidewalls.

5. A lawn bag apparatus, comprising:

a frame comprising a plurality of sidewalls arranged to approximate an opening of a lawn bag, each sidewall comprising a midwall portion extending approximately vertically, an upper wall portion extending upwardly and outwardly from or near a top edge of the midwall portion, and a lower wall portion extending downwardly and inwardly from or near a bottom edge of the midwall portion, and a clamp positioned along each of the sidewalls, the clamp comprising a grip for removably attaching the frame to the opening of the lawn bag to stabilize the opening, wherein the grip comprises a protrusion oriented at an angle relative to a wall of the lawn bag.

6. The lawn bag apparatus of claim 5, wherein the protrusion is configured to pierce and protrude through the wall of the lawn bag.

7. A lawn bag apparatus for use with lawn bags, comprising:

a plurality of frames detachably joined together to form an array of frames, each frame in the array comprising a plurality of sidewalls arranged to approximate an opening of a lawn bag, each sidewall comprising a midwall portion, an upper wall portion extending upwardly and outwardly from the midwall portion, and a lower wall portion extending downwardly and inwardly from the midwall portion, each frame further comprising a clamp hingedly positioned along each of the sidewalls for detachably attaching the frame to one of a plurality of lawn bags, wherein the clamp comprises at least one protrusion for piercing and protruding at least partially through a wall of a corresponding one of the plurality of lawn bags.

* * * * *